US007677065B1

(12) United States Patent
Miao

(10) Patent No.: US 7,677,065 B1
(45) Date of Patent: Mar. 16, 2010

(54) LOCK FOR A USB CONNECTOR

(75) Inventor: Tony Miao, Taipei Hsien (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,362

(22) Filed: Nov. 18, 2008

(51) Int. Cl.
*E05B 65/00* (2006.01)

(52) U.S. Cl. ..... 70/57; 70/58; 70/21; 439/133

(58) Field of Classification Search ..... 70/21–28, 70/57, 58; 439/131, 133, 135, 352, 353, 439/680
See application file for complete search history.

(56) References Cited

U.S. PATENT DOCUMENTS 6,877,345 B1 * 4/2005 Misner et al. ..... 70/25
6,883,354 B1 * 4/2005 Yu ..... 70/18
7,275,941 B1 * 10/2007 Bushby ..... 439/133
7,390,201 B1 * 6/2008 Quinby et al. ..... 439/133
7,424,813 B2 * 9/2008 Wu ..... 70/58
7,428,834 B1 * 9/2008 Lee ..... 70/57
7,479,021 B2 * 1/2009 Huang ..... 439/133
2003/0220002 A1 * 11/2003 Chen ..... 439/133
2003/0224637 A1 * 12/2003 Ling ..... 439/133
2006/0134962 A1 * 6/2006 Yeh ..... 439/352
2007/0037454 A1 * 2/2007 Bushby ..... 439/680
2007/0254514 A1 * 11/2007 Weksler et al. ..... 439/296
2008/0064271 A1 * 3/2008 Hiew et al. ..... 439/892
2009/0042433 A1 * 2/2009 Bushby ..... 439/352

* cited by examiner

*Primary Examiner*—Suzanne D Barrett
(74) *Attorney, Agent, or Firm*—Posz Law Group, PLC

(57) ABSTRACT

A lock for a USB connector has a shell with an end opening, multiple lock assemblies mounted rotatably through the shell and an actuator mounted pivotally in the shell. Each lock assembly has a locking notch. The actuator has multiple locking protrusions selectively engaging the locking notches. The USB connector is inserted through the end opening into the shell and is selectively locked by a mounting segment on the actuator.

8 Claims, 5 Drawing Sheets

LOCK FOR A USB CONNECTOR

BACKGROUND OF THE INVENTION

1. Field of the Invention

The present invention relates to a lock, especially to a lock that is used to selectively lock a USB connector.

2. Description of the Prior Arts

USB connectors are widely used to connect peripheral devices to the computer. The connection compatibility was further improved by development automatic driver configuration software in operating systems, such as Microsoft Corporations, plug-and-play system for Windows. The automatic driver configuration software detects when a peripheral is connected using the USB port and automatically finds a corresponding driver for the peripheral. Therefore, the peripheral can be used after plugging into the computer through the USB port without manually installing any drivers. One of the widely used peripheral with USB connector is flash memory drive.

To keep the information saved in the flash memory drive from being stolen, some software is developed but the software is usually expensive. Therefore, the conventional USB lock is developed to physically lock the USB connector of the flash memory drive. However, the conventional USB lock has complicated structures that are hard to manufacture and is cost much.

To overcome the shortcomings, the present invention provides a lock for a USB connector to mitigate or obviate the aforementioned problems.

SUMMARY OF THE INVENTION

The main objective of the present invention is to provide a lock for a USB connector with simplified structure. The lock for a USB connector has a shell with an end opening, multiple lock assemblies mounted rotatably through the shell and an actuator mounted pivotally in the shell. Each lock assembly has a locking notch. The actuator has multiple locking protrusions selectively engaging the locking notches. The USB connector is inserted through the end opening into the shell and is selectively locked by a mounting segment on the actuator.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
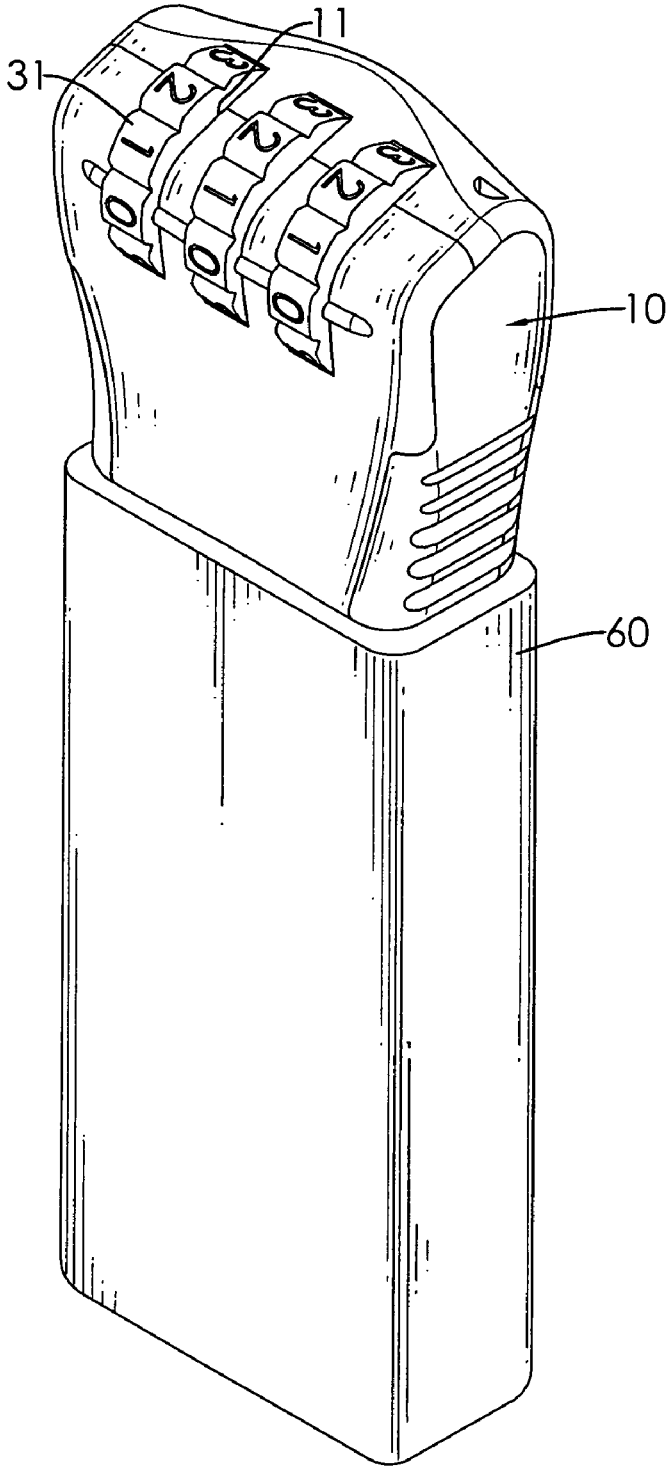
FIG. 1 is an operational perspective view of a lock in accordance with the present invention with a USB connector.
Figure 2:
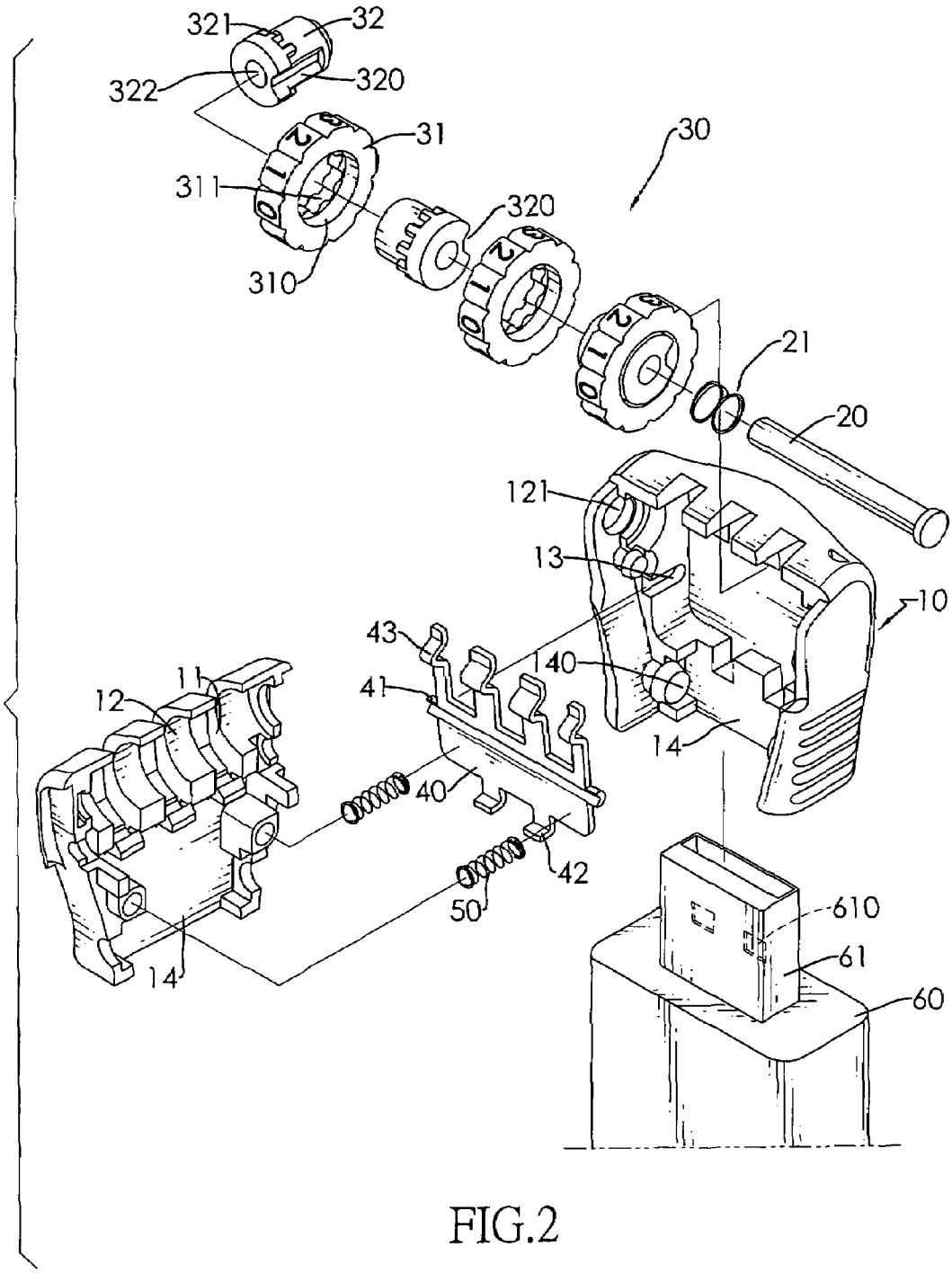
FIG. 2 is an operational exploded perspective view of the lock in FIG. 1 with the USB connector.

With reference to FIGS. 1 and 2, a lock for a USB connector in accordance with the present invention comprises a shell (10), multiple lock assemblies (30), a shaft (20), a retaining spring (21), an actuator (40) and at least one actuating spring (50).

The shell (10) is hollow, may comprise two half shells and has two inner sidewalls, a lock end, a mounting end, a transverse cavity (12), multiple mounting gaps (11), a side opening (121), two pivoting recesses (13), an end opening (14) and two limits (140). The mounting end is opposite to the lock end and is adjacent to the inner sidewalls. The transverse cavity (12) is adjacent to the lock end. The mounting gaps (11) are formed parallelly through the lock end and intersect and communicate with the transverse cavity (12). The side opening (121) is formed through one of the inner sidewalls and communicates with the transverse cavity (12). The pivoting recesses (13) are formed respectively in the inner sidewalls of the shell (10). The end opening (14) is formed through the mounting end of the shell (10) and communicates with the transverse cavity (12). The limits (140) are formed respectively on and protrude from the inner sidewalls of the shell (10) and are adjacent to the end opening (14).

The lock assemblies (30) are mounted rotatably through the shell (10). Each lock assembly (30) has a tumbler wheel (31), a sleeve (32) and a locking notch (320).

The tumbler wheel (31) is mounted rotatably through a corresponding mounting gap (11) of the shell (10), protrudes into the transverse cavity (12) and has a central hole (310), an inner sidewall, an outer sidewall, multiple mounting recesses (311) and multiple patterns. The central hole (310) is formed axially through the tumbler wheel (31). The mounting recesses (311) are formed continuously in the inner sidewall of the tumbler wheel (31). The patterns are formed continuously on the outer sidewall of the tumbler wheel (31) and may be numbers.

The sleeve (32) is mounted through the central hole (310) of the tumbler wheel (31), selectively connects securely to the tumbler wheel (31) and has a central hole (322), an outer sidewall and multiple teeth (321). The sleeves (32) of the lock assemblies (30) abut to each other. The central hole (322) is formed axially through the sleeve (32). The teeth (321) are formed separately on the outer sidewall of the sleeve (32) and selectively engages the mounting recesses (311) of the tumbler wheel (31) to connect the sleeve (32) securely to the tumbler wheel (31).

The locking notch (320) is formed in the lock assembly (30) and may be formed in the outer sidewall of the sleeve (32). The locking notches (320) of the lock assemblies (30) selectively align with each other.

The shaft (20) is mounted through the side opening (121) of the shell (10), is mounted in the transverse cavity (12) and is mounted rotatably through central holes (322) of the sleeves (32) of the lock assemblies (30).

The retaining spring (21) is mounted around the shaft (20), is mounted in the transverse cavity (12) and abuts the sleeve (32) of one of the lock assemblies (30) so that the sleeves (32) of the lock assemblies (30) abut to each other and the teeth (321) of the sleeves (32) normally engage the mounting recesses (311) of the tumbler wheel (31).

Figure 3:
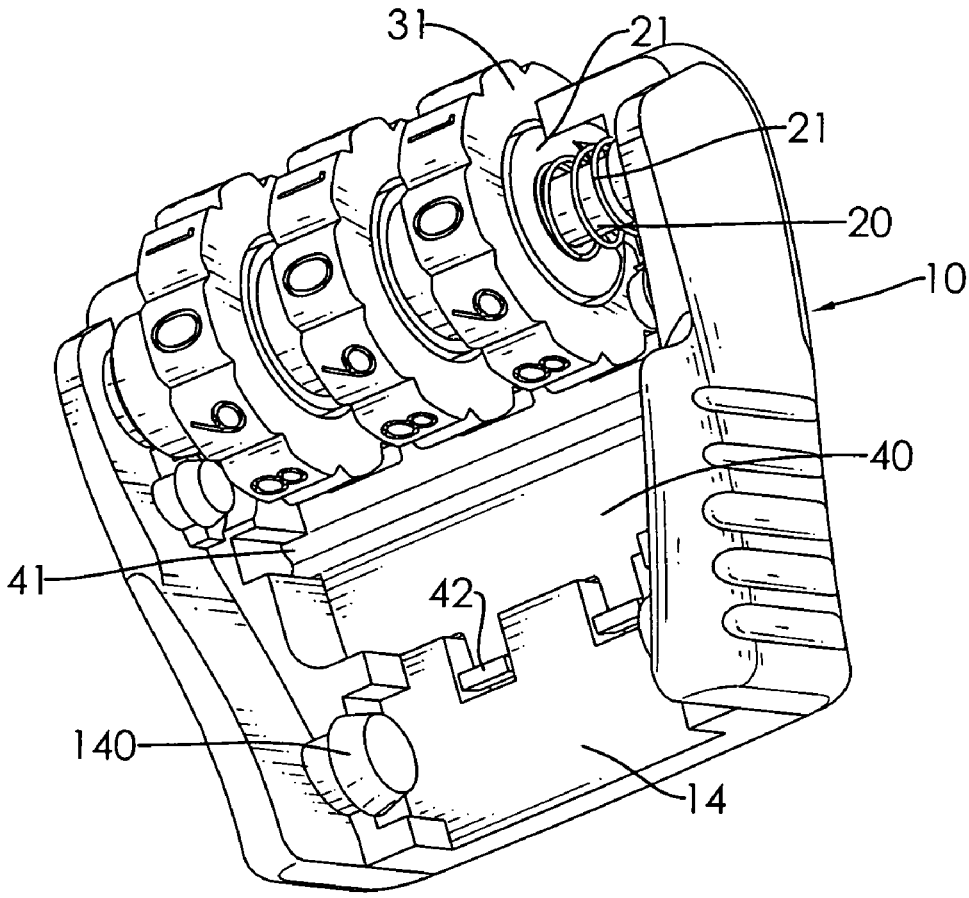
FIG. 3 is an enlarged partially perspective view of the lock in FIG. 1.

With further reference to FIG. 3, the actuator (40) is mounted pivotally in the shell (10) and has two sides, a lock end, a mounting end, two pivoting protrusions (41), a mounting segment and multiple locking protrusions (43). The lock end of the actuator (40) corresponds to the lock end of the shell (10). The mounting end of the actuator (40) corresponds to the mounting end of the shell (10). The pivoting protrusions (41) are formed respectively on the sides of the actuator (40) and are respectively mounted rotatably in the pivoting recesses (13) of the shell (10) to mount the actuator (40)

pivotally in the shell (10). The mounting segment is formed on the mounting end of the actuator (40) and may be two hooks (42) being bent from the mounting end of the actuator (40). The locking protrusions (43) are formed separately on the lock end of the actuator (40) and selectively and respectively engage the locking notches (320) of the lock assemblies (30).

The at least one actuating spring (50) is attached securely to the shell (10) and pushes the actuator (40) to force the locking protrusions (43) abutting the sleeves (32).

To unlock the lock in accordance with the present invention, the tumbler wheels (31) are rotated to rotate the sleeves (32) by the engagement between the mounting recesses (311) and the teeth (321). When the locking notches (320) of the sleeves (32) align with each other and correspond to the locking protrusions (43) of the actuator (40), the locking protrusions (43) engage with the locking notches (320). Therefore, the lock in accordance with the present invention is at unlocking status.

When the lock in accordance with the present invention is unlocked, the user may push one of the sleeves (32) from the side opening (121) of the shell (10) to disengage the teeth (321) from the mounting recesses (311). Then the tumbler wheels (31) may be rotated to change the lock code.

Figure 4:
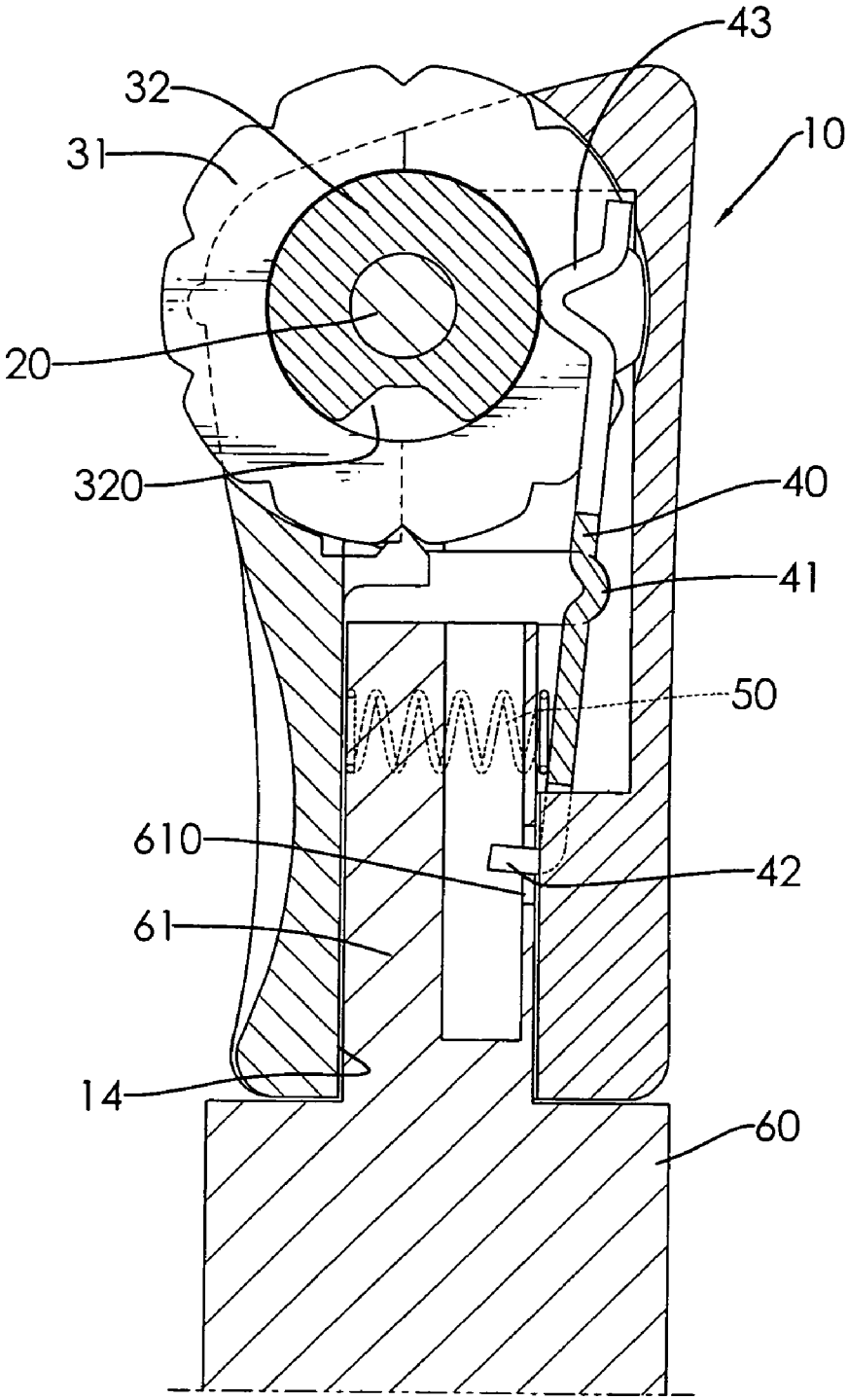
FIG. 4 is an operational side view in partial section of the lock in FIG. 1 with the USB connector, shown locked.

With further reference to FIG. 4, a flash memory drive (60) has a USB connector (61). The USB connector (61) has two through holes (610). The USB connector (61) is inserted into the mounting end of the shell (10). The limits (140) guide the USB connector (61) to be properly inserted. Rotating the tumbler wheels (31) disengages the locking notches (320) from the locking protrusions (43). Then the actuator (40) is pivoted and the hooks (42) protrude into the through holes (610) of the USB connector (61) to hold the USB connector (61) securely in the shell (10). Therefore, the lock in accordance with the present invention locks the USB connector (61) of the flash memory drive (60).

Figure 5:
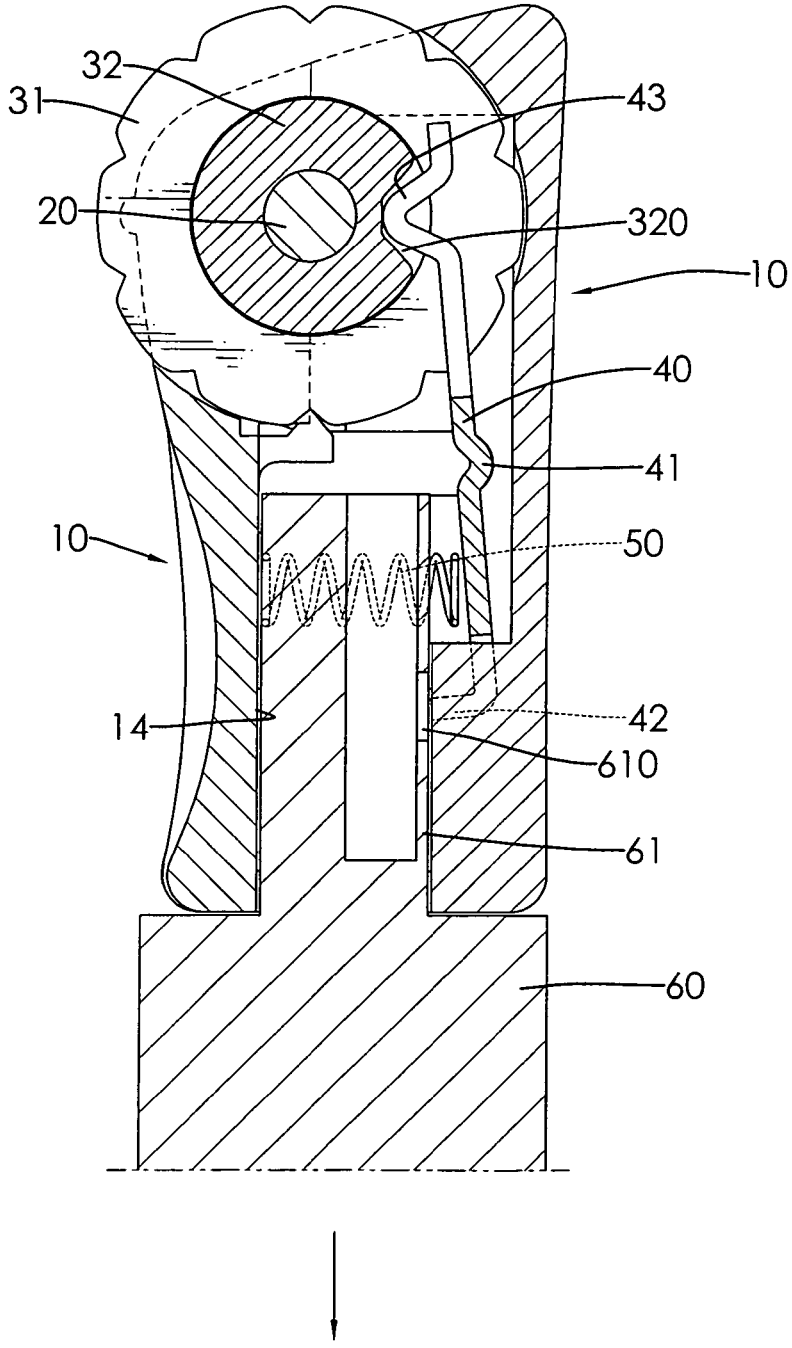
FIG. 5 is an operational side view in partial section of the lock in FIG. 1 with the USB connector, shown unlocked.

With further reference to FIG. 5, the tumbler wheels (31) is rotated to engage the locking protrusions (43) with the locking notches (320) and the at least one actuating spring (50) pushes the actuator (40) to pivot. Then the hooks (42) leave the through holes (610) of the USB connector (61). Therefore, the lock in accordance with the present invention is unlocked and the USB connector (61) is free to leave the shell (10).

Thus, the lock in accordance with the present invention is easily to lock and unlock the USB connector (61) and also has simplified structures to reduce the cost and manufacture.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lock for a USB connector comprising:

a shell being hollow and has two inner sidewalls;

a lock end;

a mounting end being opposite to the lock end and being adjacent to the inner sidewalls; and an end opening being formed through the mounting end of the shell;

multiple lock assemblies being mounted rotatably through the shell, and each lock assembly having a locking notch being formed in the lock assembly, wherein the locking notches of the lock assemblies selectively align with each other;

an actuator being mounted pivotally in the shell and having two sides;

a lock end of the actuator corresponding to the lock end of the shell;

a mounting end of the actuator corresponding to the mounting end of the shell;

a mounting segment being formed on the mounting end of the actuator; and multiple locking protrusions being formed separately on the lock end of the actuator and selectively and respectively engaging the locking notches of the lock assemblies; and at least one actuating spring being mounted in the shell and pushing the actuator, wherein the mounting segment of the actuator comprises two hooks being bent from the mounting end of the actuator.

2. The lock as claimed in claim 1, wherein the shell has a transverse cavity being adjacent to the lock end of the shell;

multiple mounting gaps being formed parallelly through the lock end of the shell and intersecting and communicating with the transverse cavity; and a side opening being formed through one of the inner sidewalls of the shell and communicating with the transverse cavity;

each lock assembly has a tumbler wheel being mounted rotatably through a corresponding mounting gap of the shell, protruding into the transverse cavity and having a central hole being formed axially through the tumbler wheel;

an inner sidewall;

an outer sidewall;

multiple mounting recesses being formed continuously in the inner sidewall of the tumbler wheel; and multiple patterns being formed continuously on the outer sidewall of the tumbler wheel; and a sleeve being mounted through the central hole of the tumbler wheel, selectively connecting securely to the tumbler wheel and having a central hole being formed axially through the sleeve;

an outer sidewall; and multiple teeth being formed separately on the outer sidewall of the sleeve and selectively engaging the mounting recesses of the tumbler wheel; and the locking notch of each lock assembly is formed in the outer sidewall of the sleeve.

3. The lock as claimed in claim 2 further comprising a shaft being mounted through the side opening of the shell, being mounted in the transverse cavity and being mounted rotatably through central holes of the sleeves of the lock assemblies.

4. The lock as claimed in claim 3 further comprising a retaining spring being mounted around the shaft, being mounted in the transverse cavity and abutting the sleeve of one of the lock assemblies.

5. The lock as claimed in claim 1, wherein the shell has two pivoting recesses being formed respectively in the inner sidewalls of the shell; and the actuator has two pivoting protrusions being formed respectively on the sides of the actuator and being respectively mounted rotatably in the pivoting recesses of the shell.

6. The lock as claimed in claim 4, wherein the shell has two pivoting recesses being formed respectively in the inner sidewalls of the shell; and the actuator has two pivoting protrusions being formed respectively on the sides of the actuator and being respectively mounted rotatably in the pivoting recesses of the shell.

7. The lock as claimed in claim 1, wherein the shell has two limits being formed respectively on and protruding from the inner sidewalls of the shell and being adjacent to the end opening.

8. The lock as claimed in claim 1, wherein the shell comprises two half shells.

* * * * *